US008572801B2

(12) United States Patent
Engström et al.

(10) Patent No.: US 8,572,801 B2
(45) Date of Patent: Nov. 5, 2013

(54) VACUUM CLEANER AIR OUTLET

(75) Inventors: Christer Engström, Åkersberga (SE); Ulrik Danestad, Huddinge (SE)

(73) Assignee: AB Electrolux, Stockholm (SE)

( * ) Notice: Subject to any disclaimer, the term of this patent is extended or adjusted under 35 U.S.C. 154(b) by 0 days.

(21) Appl. No.: 13/124,236

(22) PCT Filed: Oct. 8, 2009

(86) PCT No.: PCT/EP2009/007207

§ 371 (c)(1), (2), (4) Date: Feb. 10, 2012

(87) PCT Pub. No.: WO2010/040523

PCT Pub. Date: Apr. 15, 2010

(65) Prior Publication Data

US 2012/0124770 A1 May 24, 2012

Related U.S. Application Data

(60) Provisional application No. 61/106,080, filed on Oct. 16, 2008.

(30) Foreign Application Priority Data

Oct. 10, 2008 (SE) ..... 0802182

(51) Int. Cl.
*A47L 5/28* (2006.01)

(52) U.S. Cl.
USPC ..... 15/339; 15/344; 15/351; 15/DIG. 8

(58) Field of Classification Search
USPC ..... 15/344, 339, 351, DIG. 8
See application file for complete search history.

(56) References Cited

U.S. PATENT DOCUMENTS

| | | | |
|---|---|---|---|
| 2004/0134025 | A1 | 7/2004 | Murphy et al. |
| 2007/0136984 | A1 | 6/2007 | Hsu |
| 2008/0040883 | A1 | 2/2008 | Beskow et al. |

*Primary Examiner* — David Redding
(74) *Attorney, Agent, or Firm* — Hunton & Williams LLP

(57) ABSTRACT

Vacuum cleaner (1) of stick or upright type, which vacuum cleaner (1) comprises a housing (2), a nozzle (3) with an air inlet (4), a dust separation chamber (5), a fan unit (6) and at least one air outlet, whereby the fan unit (6) is adapted to create an air flow in a flow path extending from the air inlet (4) via the dust separation chamber (5) to the air outlet, and whereby the housing (2) comprises two main separate parts (7, 8) connectable to each other, of which one part (7) comprises the dust separation chamber (5) and the fan unit (6), and the other part (8) comprises a handle for the stick or upright type vacuum cleaner. At least one air outlet (15) is placed in the part (8) comprising the handle.

6 Claims, 4 Drawing Sheets

VACUUM CLEANER AIR OUTLET

TECHNICAL FIELD OF THE INVENTION

The invention relates to a vacuum cleaner having two separate parts connectable to each other, according to the preamble of claim 1.

BACKGROUND

It is known since long that batteries used for driving a vacuum cleaner need to be cooled to be used as efficiently as possible and to last as long as possible. One way of cooling them is to lead the air flow created by the vacuum cleaner past the batteries.

It has also been known since long to make stick or upright type vacuum cleaners in two parts connectable to each other in order to save space when the vacuum cleaner is stored or transported. Different solutions exist, such as making the vacuum cleaner in two separate parts connectable to each other by the user, or to make the vacuum cleaner in two different parts connected to each other via a knee joint such that the user can fold and unfold the cleaner in order to adapt it for cleaning purposes or for storing.

There has also since long been a wish to increase the battery capacity to have a longer running time and to have enough power for the fan unit to create large air flows. Also with new battery technologies is has been difficult to fit enough batteries into the vacuum cleaners to reach the desired levels regarding running time and air flow.

SUMMARY OF THE INVENTION

The purpose of this invention is to solve the problems mentioned above. This is achieved by a two part vacuum cleaner according to the preamble of claim 1 having an air outlet in the part of the vacuum cleaner comprising the handle.

By having an air outlet in the part comprising the handle it is possible to have batteries also in this part, and still have a cooling air flow past the batteries. The batteries could thereby be placed in either of the vacuum cleaner parts, or in both.

The housing of a vacuum cleaner of course comprises several different parts, but the expression "two main parts" here refers to two parts movable and connectable in relation to each other for facilitating storage and transport of the cleaner.

The vacuum cleaner preferably further comprises a duct forming a portion of the flow path and extending, for example adjacent to a space for electric wiring, between the two parts. It preferably also comprises batteries for driving the vacuum cleaner placed after the fan unit in the part comprising the dust separation chamber and the fan unit, or in the part comprising the handle, or in both parts. The two parts are preferably adapted to be connected to each other by a user of the cleaner either by mounting one part into the other and locking them relative to each other by a suitable fastening means, or via a knee joint. The above mentioned embodiments give advantages in terms of manufacturing and usability and performance.

Furthermore the vacuum cleaner comprises a dust container comprising an air channel extending from the part of the dust container closest to the nozzle to the inlet of the dust separation chamber. This embodiment is advantageous in that it gives few sealings between the dust container and the vacuum cleaner housing, and in that it gives a substantially impermeable construction, since possible leakage would take place inside the dust container.

BRIEF DESCRIPTION OF THE DRAWINGS

For illustrative purposes, an embodiment of the invention will now be described with reference to the drawings, on which

DETAILED DESCRIPTION OF A PREFERRED EMBODIMENT

Figure 1:
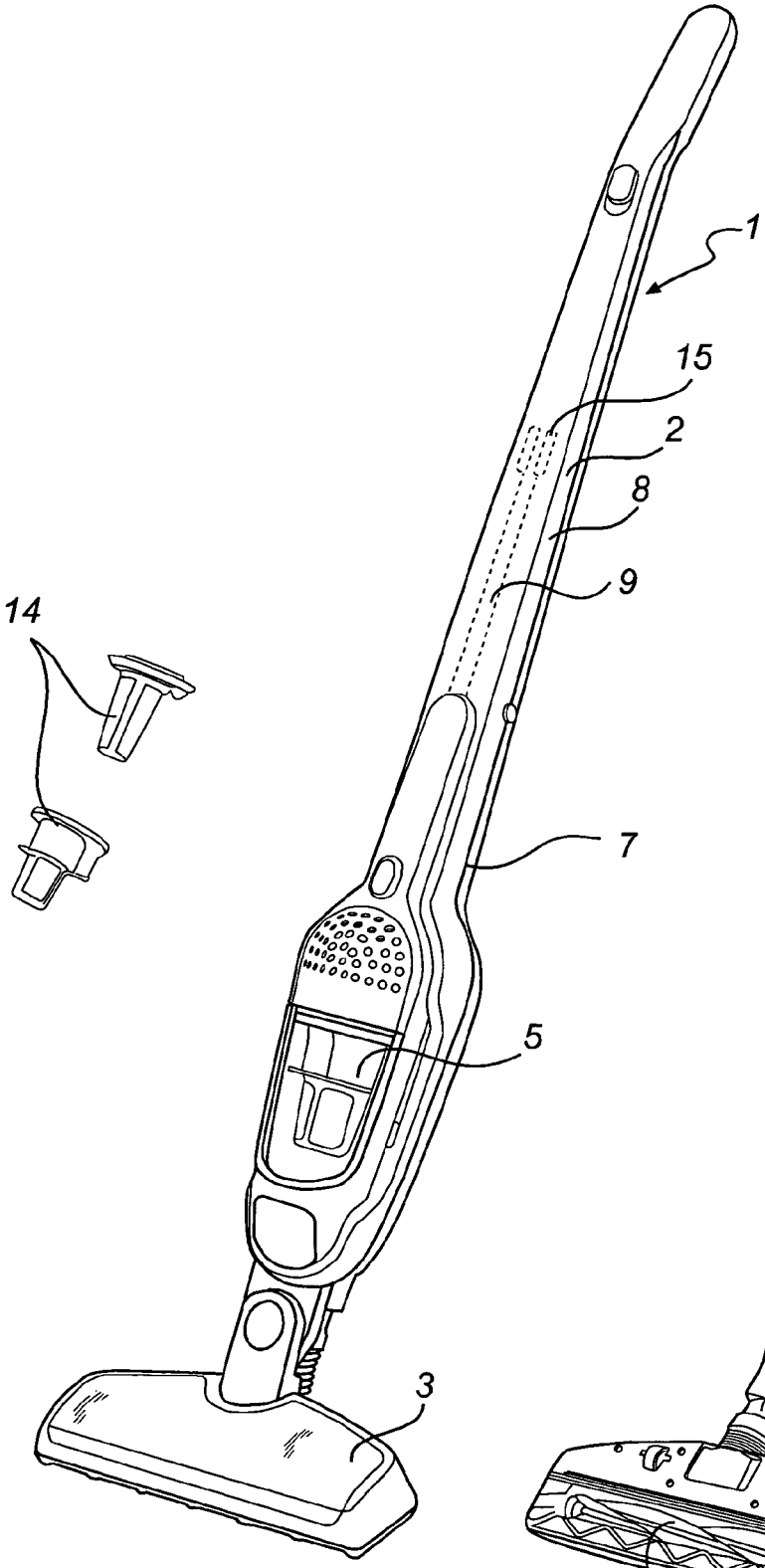
FIG. 1 is a schematic view of a vacuum cleaner according to the invention.
Figure 2:
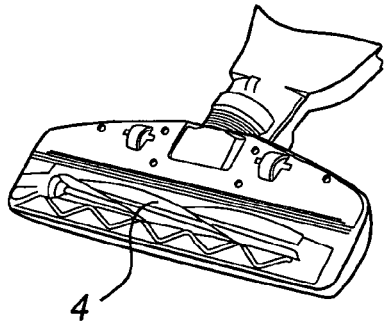
FIG. 2 is a schematic view from below of the nozzle of the vacuum cleaner in FIG. 1.
Figure 3:
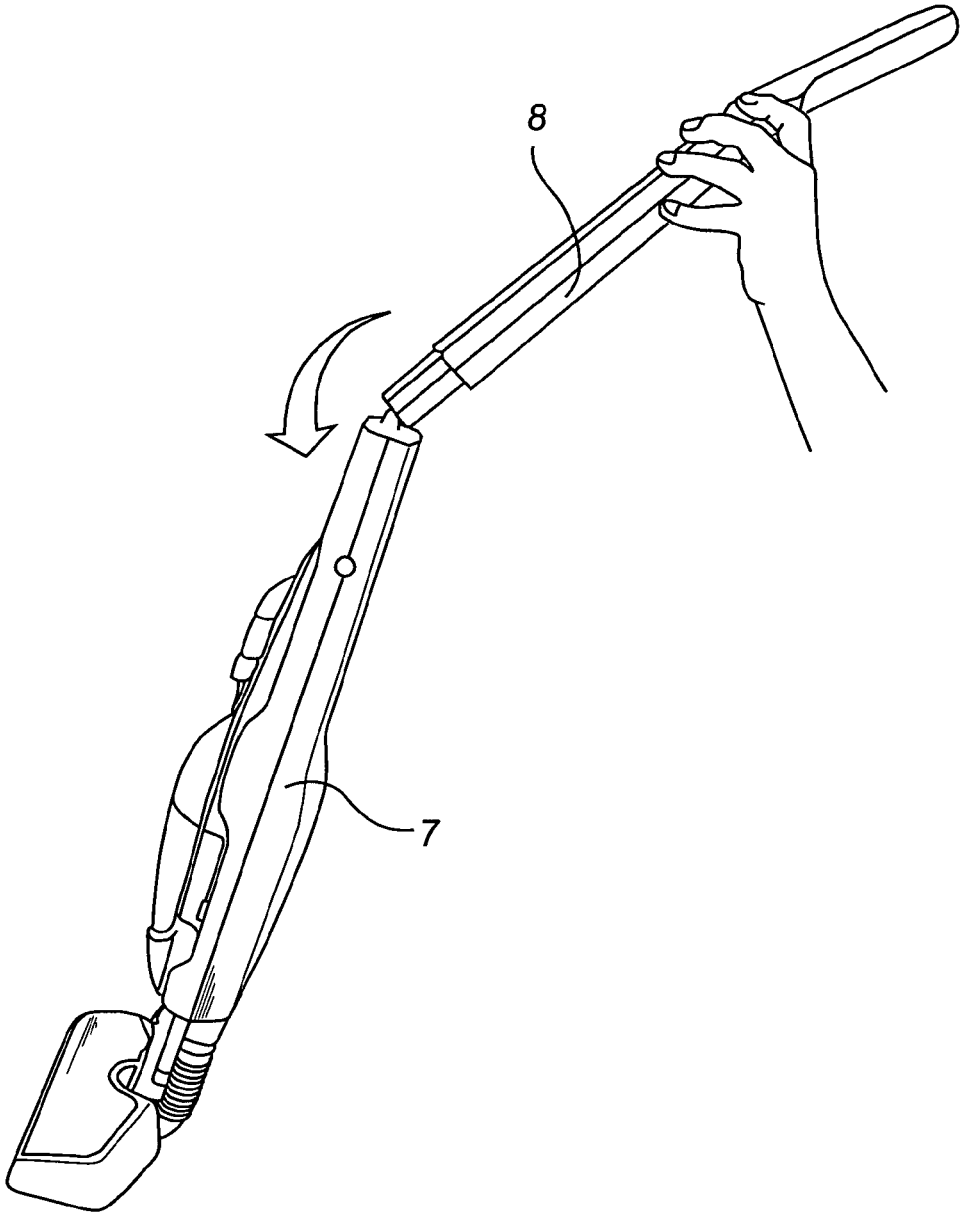
FIG. 3 is a schematic view of the vacuum cleaner according to the invention with its two parts not yet mounted to each other.
Figure 4:
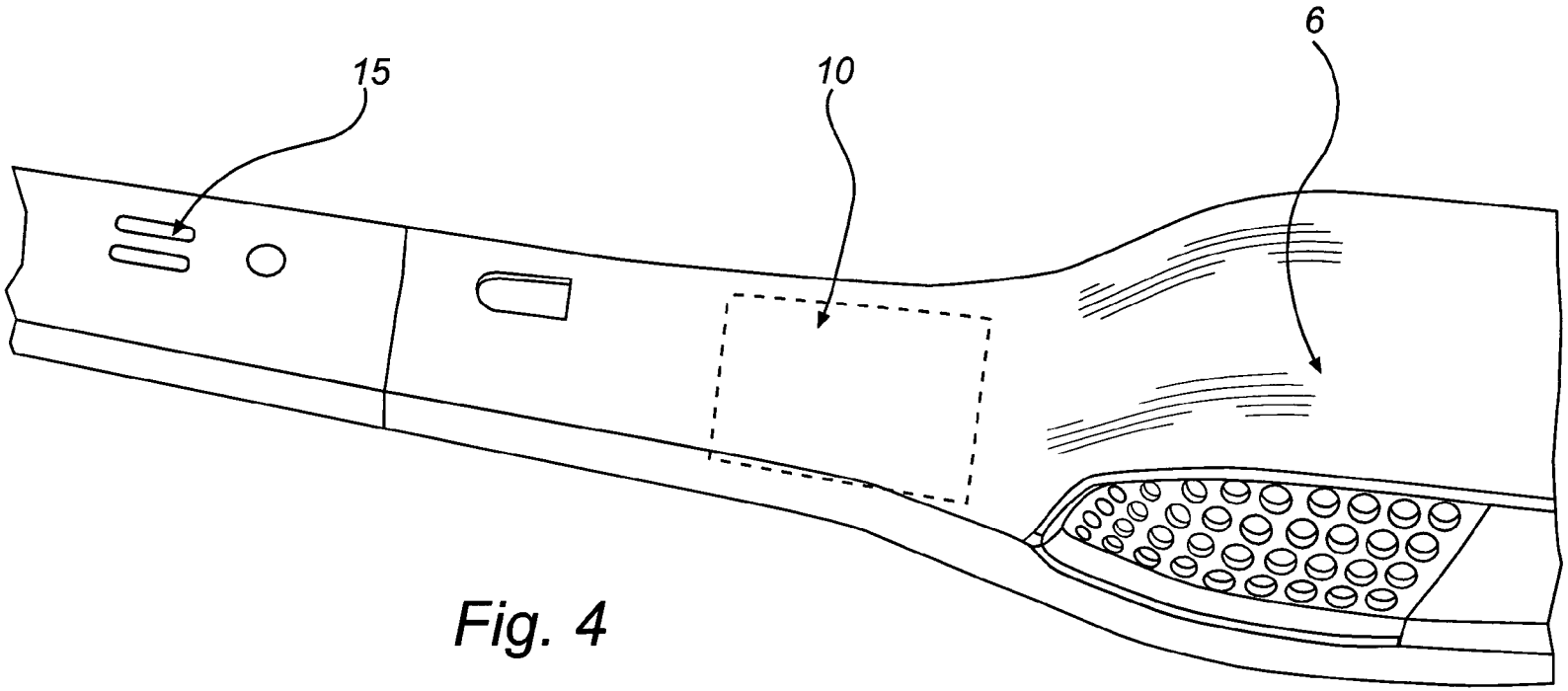
FIG. 4 is a schematic view from behind of a mid portion of a vacuum cleaner according to the invention.

FIGS. 1-4 show a vacuum cleaner 1 of stick type. It could of course also be a so called upright cleaner, and the stick could be of the type carrying a hand held vacuum cleaner with a dust container, or just a dust container. The vacuum cleaner 1 comprises a housing 2, a nozzle 3 with an air inlet 4, a dust separation chamber 5, a fan unit 6 (in the drawings the fan unit is not explicitly shown, but one possible position for it is indicated) and at least one air outlet 15. The housing 2 comprises two separate parts 7, 8 (see especially FIG. 3) connectable to each other, of which one part 7 comprises the dust separation chamber 5 and the fan unit 6, and the other part 8 comprises a handle for the stick or upright type vacuum cleaner 1. An air outlet 15 is placed in the part 8 comprising the handle. Air outlets could of course also be placed in the part 7 comprising the dust separation chamber 5 and the fan unit 6.

In use, the the fan unit 6 creates an air flow in a flow path extending from the air inlet 4 via the dust separation chamber 5 to the air outlet 15. In the embodiment in FIG. 1 the batteries 10 are placed in the part 7 comprising the fan unit 6 and the dust separation chamber 5, but it is of course also possible to place the batteries 10 in the part 8 comprising the handle, or in both parts 7, 8.

Having an air outlet 15 in the part 8 comprising the handle allows having a cooling air flow past the batteries 10 if placed in this part 8. The air is preferably led in a duct 9 leading from one part to the other. Usually there is electric wiring going from one part to the other, and the duct 9 for the cooling air flow could preferably be placed adjacent to the passage for the electric wiring.

The vacuum cleaner 1 is of the type having two separate parts 7, 8 to be mounted by the user one into the other and fixed in relation to each other by screw, but of course any other fastening means is possible, such as snap fit. Another possible solution is to connect the two parts 7, 8 to each other via a knee joint, which allows the user to fold and unfold the cleaner when stored or used respectively.

Figure 5:
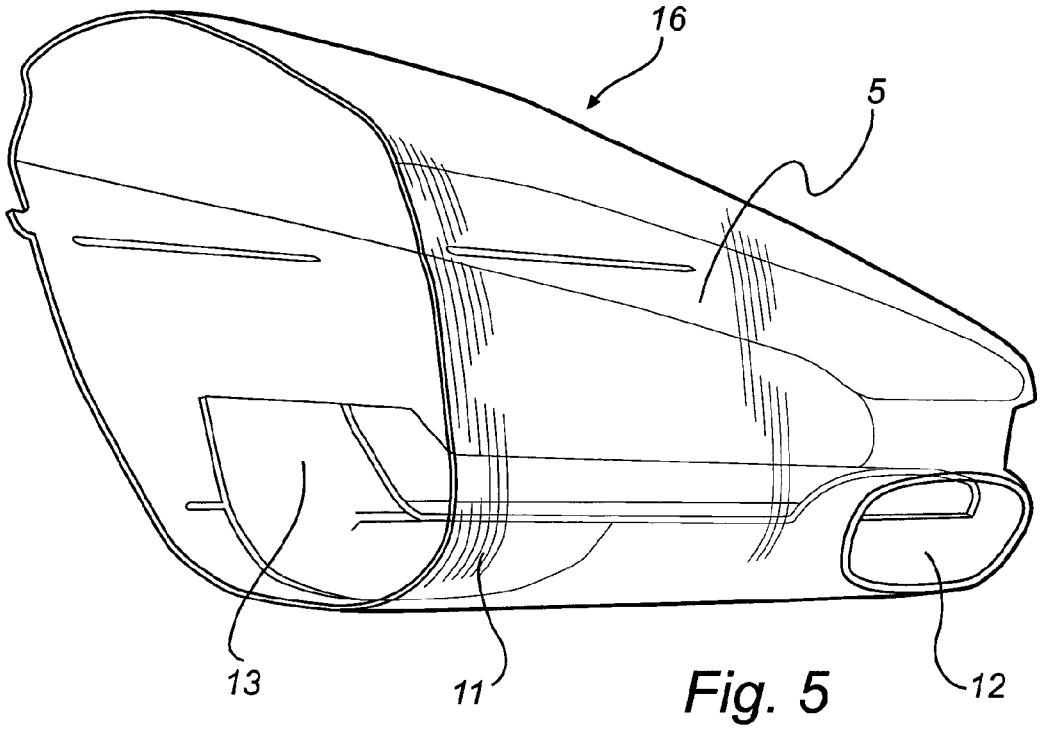
FIG. 5 is a schematic view of a dust container suitable for use in a vacuum cleaner according to the invention
Figure 6:
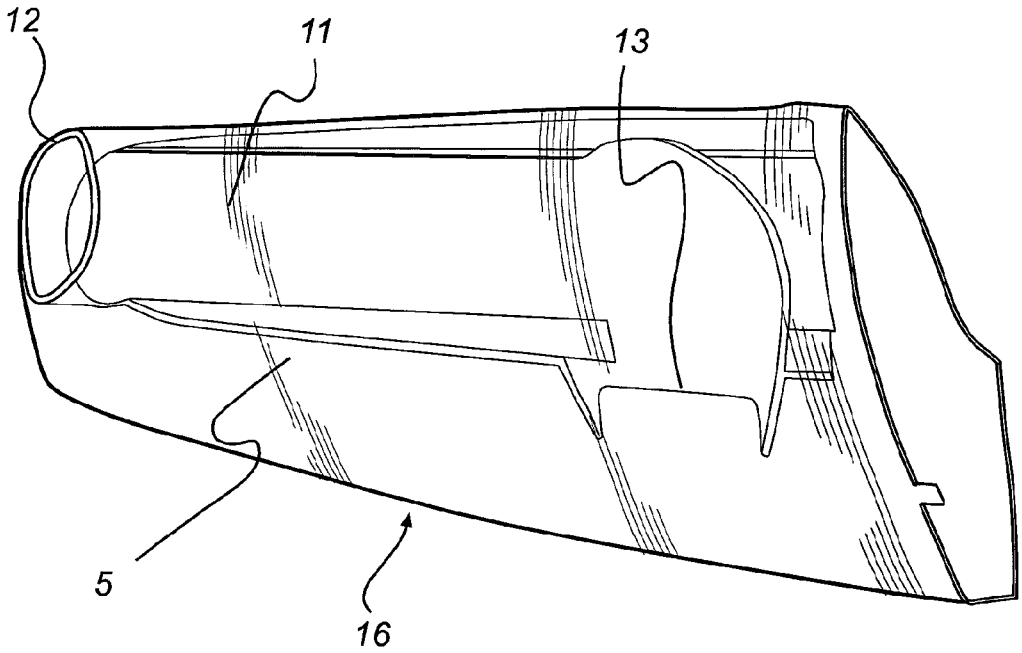
FIG. 6 is a schematic view of the dust container in FIG. 5 from another angle.

In FIGS. 5-6 is shown in greater detail a dust container 16 suitable for use in a vacuum cleaner of stick or upright type. Even though any type of dust container 16 could be used in this invention, the dust container 16 according to FIG. 5-6 is especially preferable in that it comprises an air channel 11 from its lower portion 12 closest to the nozzle 3. Traditionally this air channel 11 is comprised in the stick of the vacuum cleaner. The solution according to FIGS. 5-6 has the advantages that less sealings between the dust container 16 and the stick part 7 are needed, and that a small leakage does not affect the cleaning performance of the cleaner since the leakage would take place inside the dust separation container 16. Having the air channel outside the dust container requires much attention to the sealings and to the impermeability of the design.

The dust separation chamber 5 in the dust container 16 in FIGS. 5-6 is of cyclonic type. In use the fan unit 6 creates an air flow entering the dust container 16 at the inlet 12 of the air channel, which is positioned closest to the nozzle 3, and then entering the dust separation chamber 5 at the exit 13 of the air channel situated above its inlet 12, as seen in normal use of the cleaner 1. The air flow enters the dust separation chamber 5 tangentially, whereby a swirling motion of the air flow is created in the dust separation chamber 5. The swirling motion separates particles from the air flow, which particles are collected inside the dust container 16. At the outlet 13 of the dust separation chamber 5, a filter 14 is positioned. The filter 14 separates the finer particles not already separated by the swirling motion. The filter could be of any kind, such as a frusto conical cup shaped two part filter 14, or a pleated cylindrical filter.

The invention claimed is:

1. Vacuum cleaner of stick or upright type, which vacuum cleaner comprises a housing, a nozzle with an air inlet, a dust separation chamber, a fan unit and at least one air outlet, whereby the fan unit is adapted to create an air flow in a flow path extending from the air inlet via the dust separation chamber to the at least one air outlet, and whereby the housing comprises two main parts connectable to each other, of which one part comprises the dust separation chamber and the fan unit, and the other part comprises a handle for the stick or upright type vacuum cleaner, characterized in that at least one air outlet is placed in the part comprising the handle such that air flows past batteries placed in this part.

2. Vacuum cleaner according to claim 1, characterized in that it comprises a duct forming a portion of the flow path and extending between the two parts.

3. Vacuum cleaner according to claim 1, characterized in that additional batteries for driving the vacuum cleaner are placed after the fan unit in the part comprising the dust separation chamber and the fan unit.

4. Vacuum cleaner according to claim 1, characterized in that the two parts are adapted to be connected to each other by a user of the cleaner by mounting one part into the other and locking them relative to each other by a suitable fastening means.

5. Vacuum cleaner according to claim 1, characterized in that the two parts are connected to each other via a knee joint.

6. Vacuum cleaner according to claim 1, characterized in that it comprises a dust container comprising an air channel extending from the part of the dust container closest to the nozzle to the inlet of the dust separation chamber.

* * * * *